US006178594B1

(12) United States Patent
Koch

(10) Patent No.: US 6,178,594 B1
(45) Date of Patent: Jan. 30, 2001

(54) DOOR CHECK

(75) Inventor: John G. Koch, Gresham, OR (US)

(73) Assignee: Freightliner LLC, Portland, OR (US)

( * ) Notice: Under 35 U.S.C. 154(b), the term of this patent shall be extended for 0 days.

(21) Appl. No.: 09/327,113

(22) Filed: Jun. 7, 1999

(51) Int. Cl.[7] ..... E05F 5/06

(52) U.S. Cl. ..... 16/85; 16/86 A; 16/374; 292/268

(58) Field of Search ..... 16/82, 85, 86 A, 16/86 B, 86 C, 375, 374, 371, 377, 50, 54; 292/262, 266–270

(56) References Cited

U.S. PATENT DOCUMENTS

| | | | |
|---|---|---|---|
| 1,757,075 | 5/1930 | Earhart | 16/375 |
| 2,034,905 | 3/1936 | Jacobs . | |
| 2,039,960 | 5/1936 | Jacobs | 16/85 |
| 2,043,976 | 6/1936 | Schonitzer . | |
| 2,125,010 | 7/1938 | Wright . | |
| 2,137,197 | 11/1938 | Schonitzer . | |
| 2,140,958 | 12/1938 | Jacobs . | |
| 2,232,498 | 2/1941 | Travis . | |
| 2,237,046 | 4/1941 | Breitenwischer . | |
| 2,767,422 | 10/1956 | Ulrich | 16/85 |
| 2,882,548 | 4/1959 | Roethel | 16/82 |
| 2,980,945 | 4/1961 | Hollar, Jr. . | |
| 3,012,269 | 12/1961 | Bartel . | |
| 3,165,777 | 1/1965 | Peras . | |
| 3,392,997 | 7/1968 | Seckerson et al. . | |
| 4,532,675 | 8/1985 | Salazar . | |
| 5,444,894 | 8/1995 | Heiler | 16/85 |

FOREIGN PATENT DOCUMENTS

| | | |
|---|---|---|
| 1387137 | 3/1975 | (GB) . |

OTHER PUBLICATIONS

Photocopy of two forms of prior art door checks.

*Primary Examiner*—Chuck Y. Mah
(74) *Attorney, Agent, or Firm*—Klarquist Sparkman Campbell Leigh & Whinston LLP

(57) ABSTRACT

A door check apparatus comprises an elongated body having side walls defining a channel and an energy absorber. When the door check is mounted to a door, a pivot pin is inserted through an opening at the first end of the elongated body, and a slide pin extends through the channel. The pivot pin is attached to the door and the slide pin is attached to the structure adjacent to the door. As the door is opened, the elongated body moves relative to the slide pin to position the slide pin toward the second end portion of the elongated body. The slide pin may be positioned in any one of one or more stop positions which yieldably hold the slide pin. If the door is opened beyond its normal opening arc, the energy absorber is engaged and resists further movement of the door.

18 Claims, 5 Drawing Sheets

40
36
34
76
74
22
24
14
18
12
23
56
10
58

16
10
20
12
22
30
56
18
24
26
23

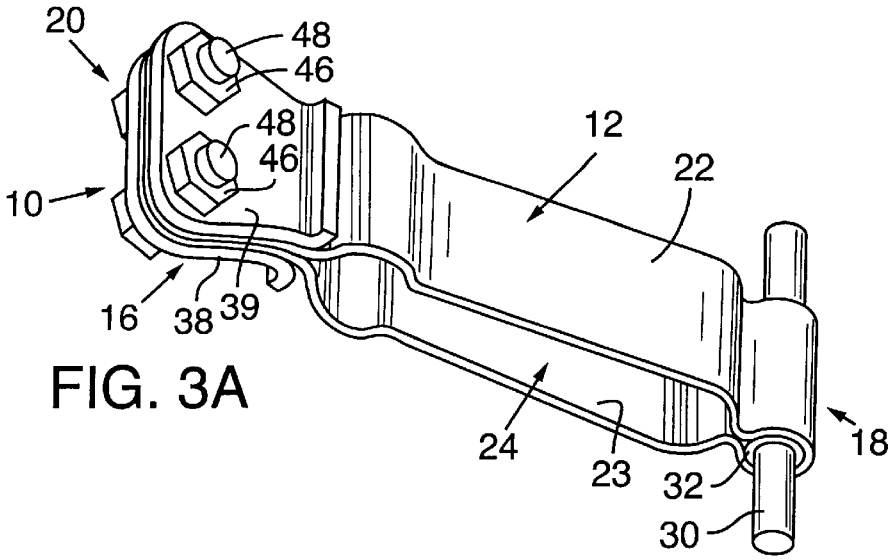
FIG. 3A
FIG. 3B
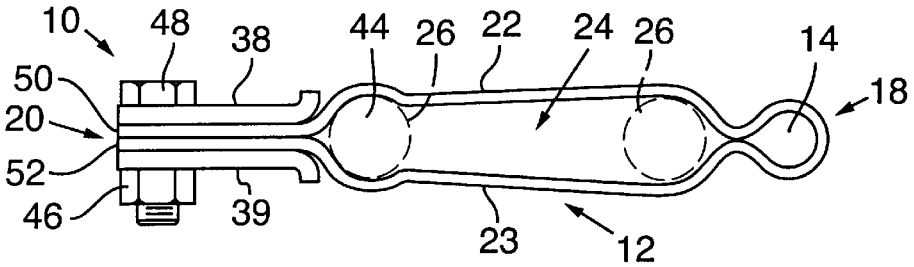
FIG. 3C
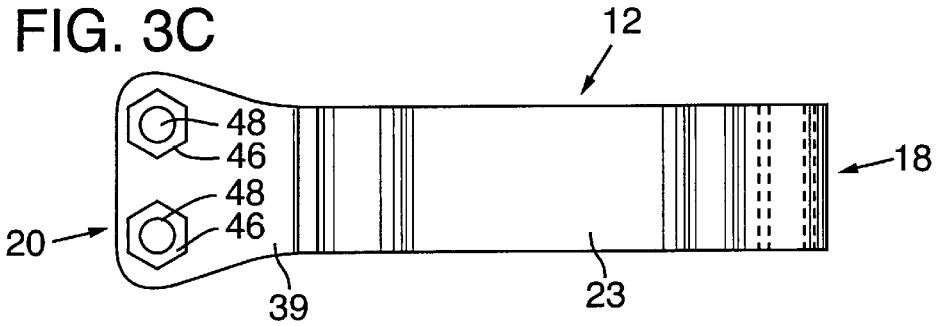
FIG. 3D
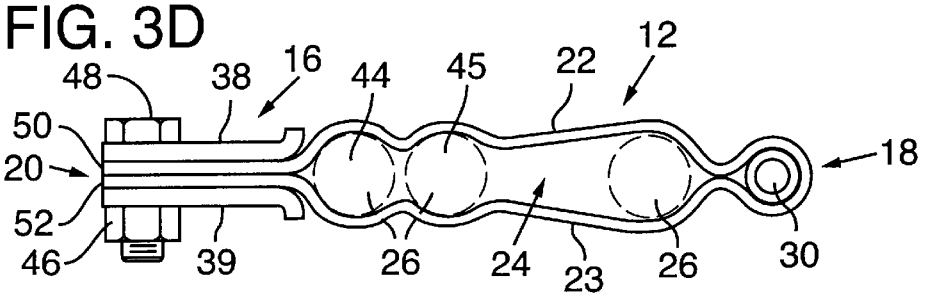

DOOR CHECK

BACKGROUND

Door checks are used to control the opening and closing of doors. A door check is generally an apparatus which holds a door in its open position and resists the closing of the door due to gravity, wind, impact, or other force. A person opening a door equipped with a door check does not therefore have to hold the door at the same time he or she accesses the space or compartment inside the door.

Door checks are particularly suitable for use in cars, trucks, and other vehicles. A door check on a vehicle passenger door, for example, allows the driver to devote his or her full attention to entering or exiting a vehicle. Without a door check, the driver may have to hold open the door with one hand while entering or exiting. A door broadly encompasses any apparatus for closing an opening. Thus, doors include vehicle hoods and trunk lids. A door check on a vehicle hood allows a mechanic to use both hands while working on the vehicle's engine. A door check on a vehicle trunk or hatchback lid allows the driver to use both arms when loading or unloading the trunk or rear compartment of the vehicle.

Door check devices have been developed in the past. Examples are set forth in U.S. Pat. No. 2,237,046, U.S. Pat. No. 2,125,010. U.S. Pat. No. 2,137,197, U.S. Pat. No. 3,165,777, and U.S. Pat. No. 3,392,997.

Although these door check designs are known, as these designs are understood, if the door is forced beyond its normal open position, the door check apparatus, and possibly the door hinges, may be damaged by the excess mechanical force associated with attempting to force the door beyond its normal open position. This can happen, for example, if the door is fully opened and then subject to impact, which urges the door to open further.

Therefore, a need exists for an improved door check.

SUMMARY OF THE INVENTION

The door check of the present invention absorbs considerable energy without damaging either the door check itself or the door hinges. Thus, the door check resists excessive door opening forces.

One embodiment of a door check includes an energy absorber operably coupled to an elongated door check body having first and second end portions. The elongated body has opposing side walls which define a channel. The energy absorber is operably coupled near the second end of the elongated body, while a pivot opening is formed at the first end of the elongated body. The energy absorber functions to absorb energy and counteract excessive mechanical torque applied to a door hinge.

In one specific embodiment of a door check apparatus, the apparatus is detachably mounted in the space adjacent to a vehicle door and door frame. In this embodiment, the pivot opening is adapted to pivotally receive a pivot pin and the pivot pin may be surrounded by a spacer. The door carries the pivot pin which is inserted through the pivot opening. In addition, a slide pin, coupled to the vehicle structure adjacent to the door frame, is inserted through the channel of the elongated body. As the door is opened, the elongated body moves relative to the slide pin, with the slide pin slidably engaging the channel. During this motion, the second end portion of the body, in effect, moves toward the slide pin. Urging the door beyond its normal full open position results in the slide pin engaging the energy absorber.

In this specific embodiment, the energy absorber absorbs some of the mechanical energy created by the movement of the door and opposes the movement of the slide pin. In one particular example, the energy absorber comprises a leaf spring having first and second leaf spring elements detachably coupled to the side walls of the elongated body outside the channel.

The side walls of the elongated body may also be adapted to create a stop position or plural stop positions. A stop position may be formed by having the side walls diverge and reconverge between the first end and second end portions of the elongated body. Each stop position is adapted to receive and yieldably hold the slide pin, thus causing the door to be yieldably held open at that particular position.

The present invention is directed toward novel and unobvious aspects of a door check, both alone and in combination with one another, as set forth in the claims below.

BRIEF DESCRIPTION OF THE DRAWINGS

FIG. 3A is a perspective view of an embodiment of a door check in accordance with the invention with a pivot pin extending through the pivot opening.

FIG. 3B is a top view of the door check of FIG. 3A.

FIG. 3C is a side view of the door check of FIG. 3A without the pivot pin.

FIG. 3D a top view of an alternative form of door check with plural stop positions.

DETAILED DESCRIPTION

Figure 1:
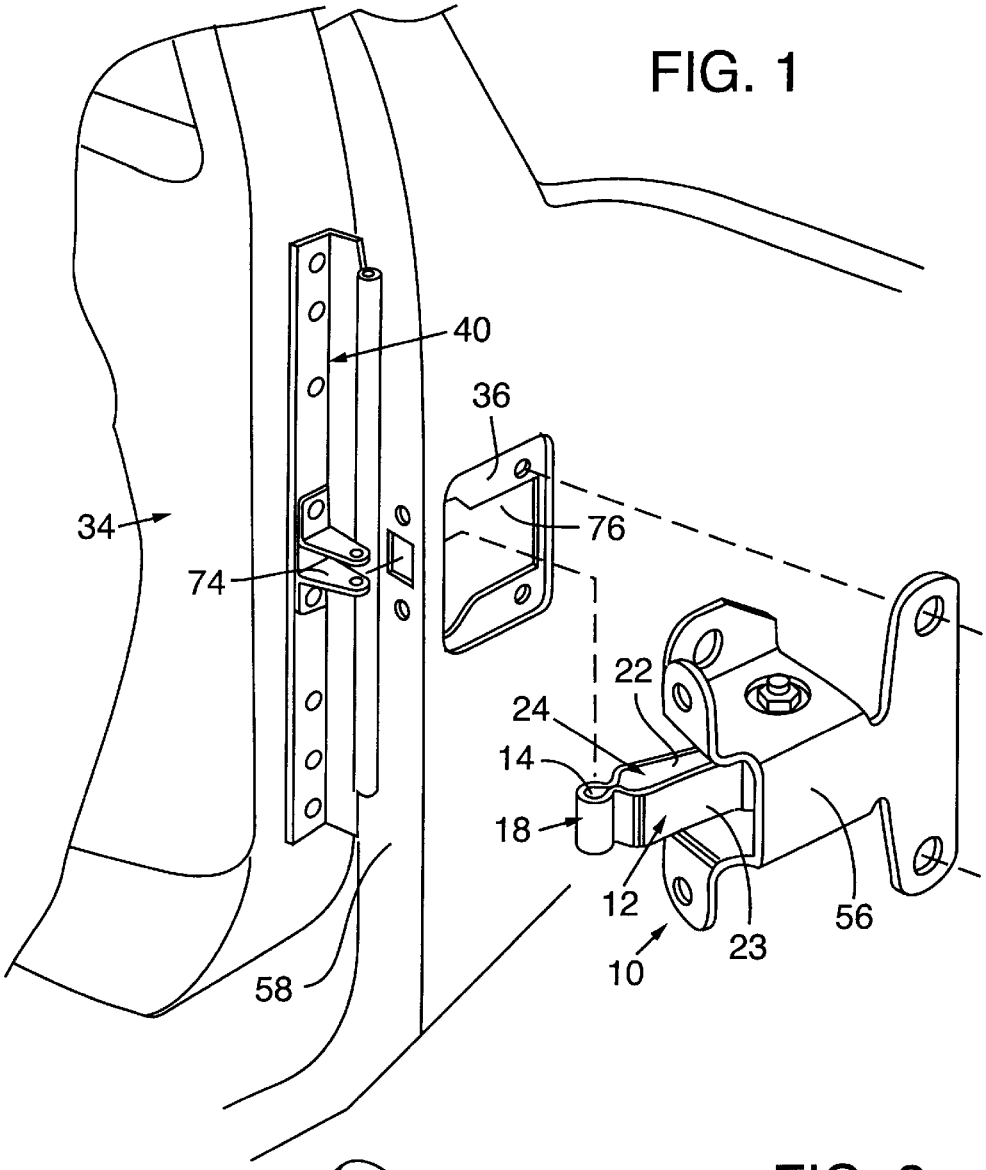
FIG. 1 is a perspective view illustrating one embodiment of a door check in accordance with the invention shown with a portion of a vehicle door and the vehicle structure adjacent to the door.
Figure 2:
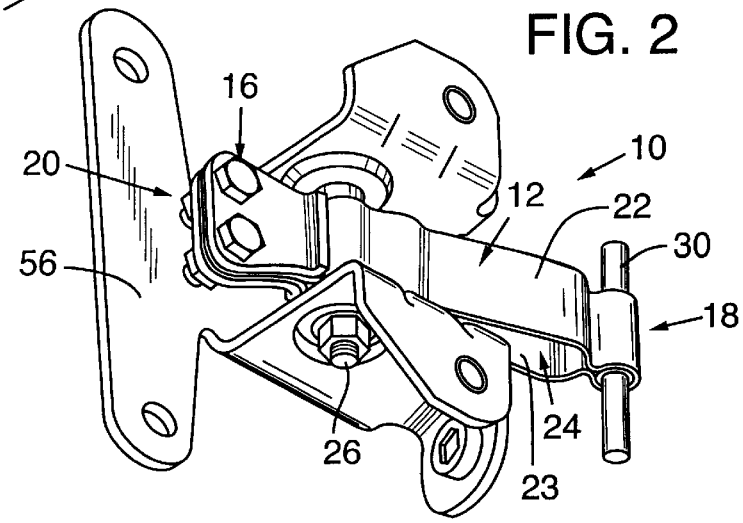
FIG. 2 is a perspective view of the door check of FIG. 1 shown coupled by a slide pin to a mounting bracket and also illustrating a door pivot pin.

One form of door check apparatus 10 in accordance with the present invention is shown in FIGS. 1 and 2. This form of door check interrupts the opening movement of a door to reduce damage to the door and to other vehicle components resulting from a door being opened with excessive force, for example, arising from a door being opened beyond its normal opening arc. The illustrated form of door check has an elongated body 12, an opening or channel 24, and an energy absorber 16. While the illustrated door check is shown in association with a vehicle door, the apparatus can be used on doors of virtually any size or shape and which are mounted on virtually any structure.

The door check 10 may be made from a variety of materials. For example, the apparatus 10 may be made from durable metals or metal alloys. As a specific example, the body 12 may be made of steel with 12 gauge 6150 hot-rolled steel being a suitable example. This material may be heat treated, for example, to 240 KSI minimum yield strength.

The elongated body 12 has a first end portion 18, a second end portion 20, and opposing side walls 22, 23 defining the channel 24. In the embodiment of FIGS. 1 and 2, the channel 24 is adapted to receive a slide pin 26.

As best seen in FIG. 3B, the elongated body 12 may be formed from a single monolithic or one-piece material, such as of a strap having a first end 50 and a second end 52. The strap is doubled back on itself to define the channel 24 and other features of the body, with the ends 50, 52 being detachably coupled together by fasteners, such as upper and lower bolts 48 and nuts 46 (see FIG. 3A). The bolts may, for example, be one-fourth inch SAE grade eight bolts. In alternative embodiments, the ends 50, 52 may be secured together using other mechanical clamping approaches. Additionally, although less convenient, the elongated body may be formed from two or more pieces.

With reference to FIGS. 3A–3D, the first end portion 18 of the elongated body 12 is formed to define a pivot receiving opening 14. The opening 14 in the form shown is adapted to pivotally receive a pivot pin 30 surrounded by a spacer 32. In the illustrated embodiments, the pivot pin 30 is coupled to the vehicle door 34 (FIG. 1) and the slide pin 26 is coupled to the vehicle structure 36 adjacent the door. The door is pivoted by hinge 40 to the vehicle frame. As the door is opened, the elongated body 12 moves relative to the slide pin 26 and shifts the second end portion 18 of the elongated body 12 toward the slide pin 26.

The slide pin may comprise a bolt, such as a three-eighths inch SAE grade eight bolt surrounded by a metal sleeve. The sleeve may be nitride case hardened to a dph 440 minimum hardness, for example, or otherwise finished. It is desirable for the bolt and sleeve to also be rust resistant. As a specific example, a Nitrotec Surface Treatment Process, available from Ipsen Commercial Heat Treating of Rockford, Ill., may be used.

The side walls 22, 23 of the elongated body 12 may also be adapted to create a stop position 44 (FIG. 3B) or plural stop positions, such as the two stop positions 44, 45 shown in FIG. 3D. A stop position is formed in this embodiment when the side walls diverge and reconverge between the first end portion 18 and second end portion 20 of the elongated body 12. Each stop position 44, 45 is adapted to receive and yieldably hold the slide pin 26. When the slide pin 26 enters a stop position 44 or 45 (or, more accurately, when the elongated body 12 is moved so that the portion of the body defining the stop positions surrounds the slide pin 26), the door is yieldably held open at that position. If the door is then opened or closed, the side walls 22 of the elongated body 12 yield slightly as the slide pin 26 is moved out of the stop position. Alternative embodiments having three or more stop positions are also possible. In addition, other forms of stop mechanisms may be used.

An energy absorber 16 is positioned adjacent to the second end 20 portion of the elongated body 12 in a position to absorb energy as the door 34 (FIG. 1) approaches its fully open position. The energy absorber 16 functions to absorb energy and counteract the excess mechanical torque applied to a door 34 (FIG. 1) if the door is opened beyond its normal opening arc 42 (FIGS. 4A and 4C). The energy absorber functions by opposing the movement of the slide pin 26 relative to the elongated body 12. The illustrated energy absorber thus minimizes possible damage to the door and other vehicle components if the door 34 is urged open with excessive force and also allows the door to be opened beyond its normal full open position.

Figure 4B:
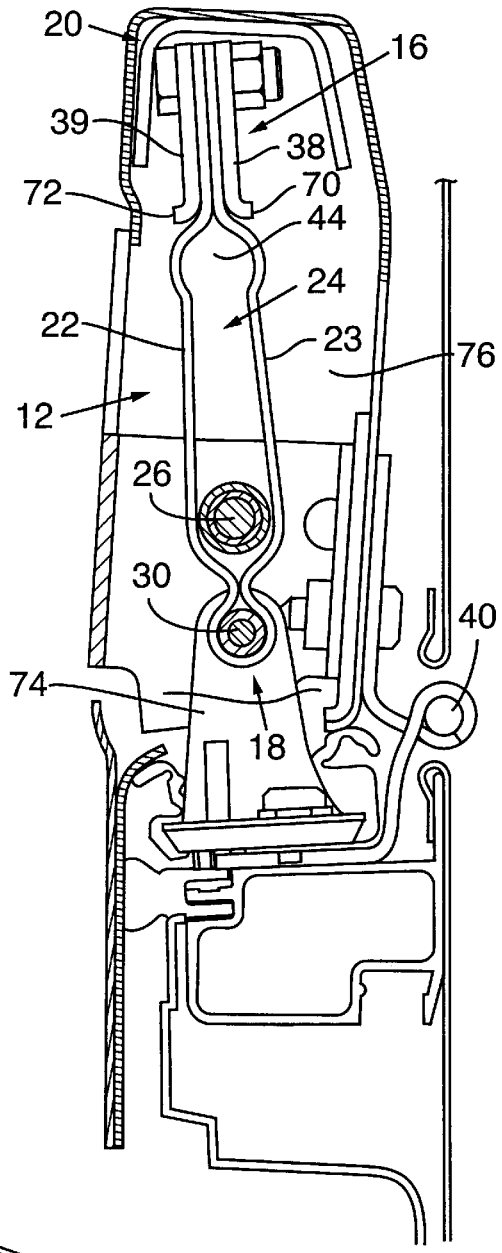
FIG. 4B is a top view of the embodiment of FIG. 4A with the door shown in a closed position.
Figure 4A:
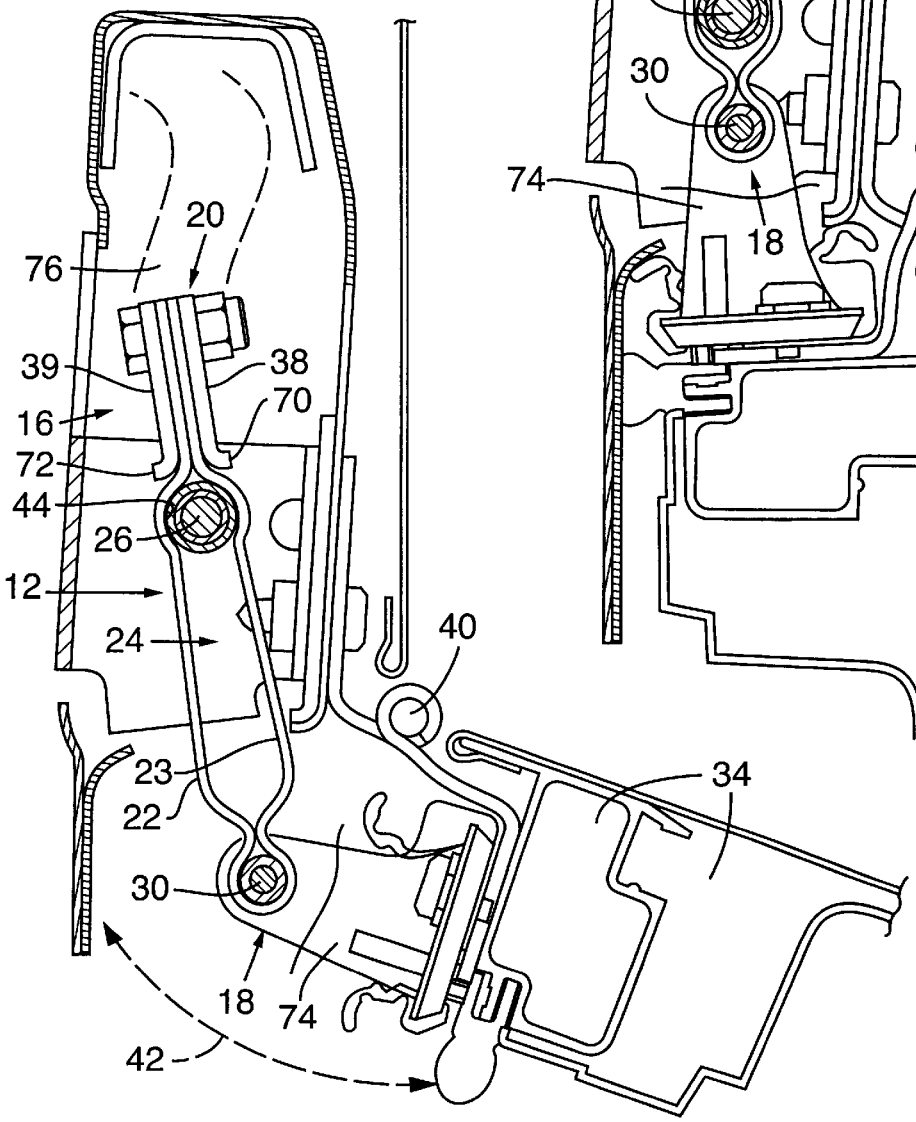
FIG. 4A is a top view of the door check of FIG. 1 mounted in the space between the door and the structure adjacent to the door with the door in a normal full open position.
Figure 4C:
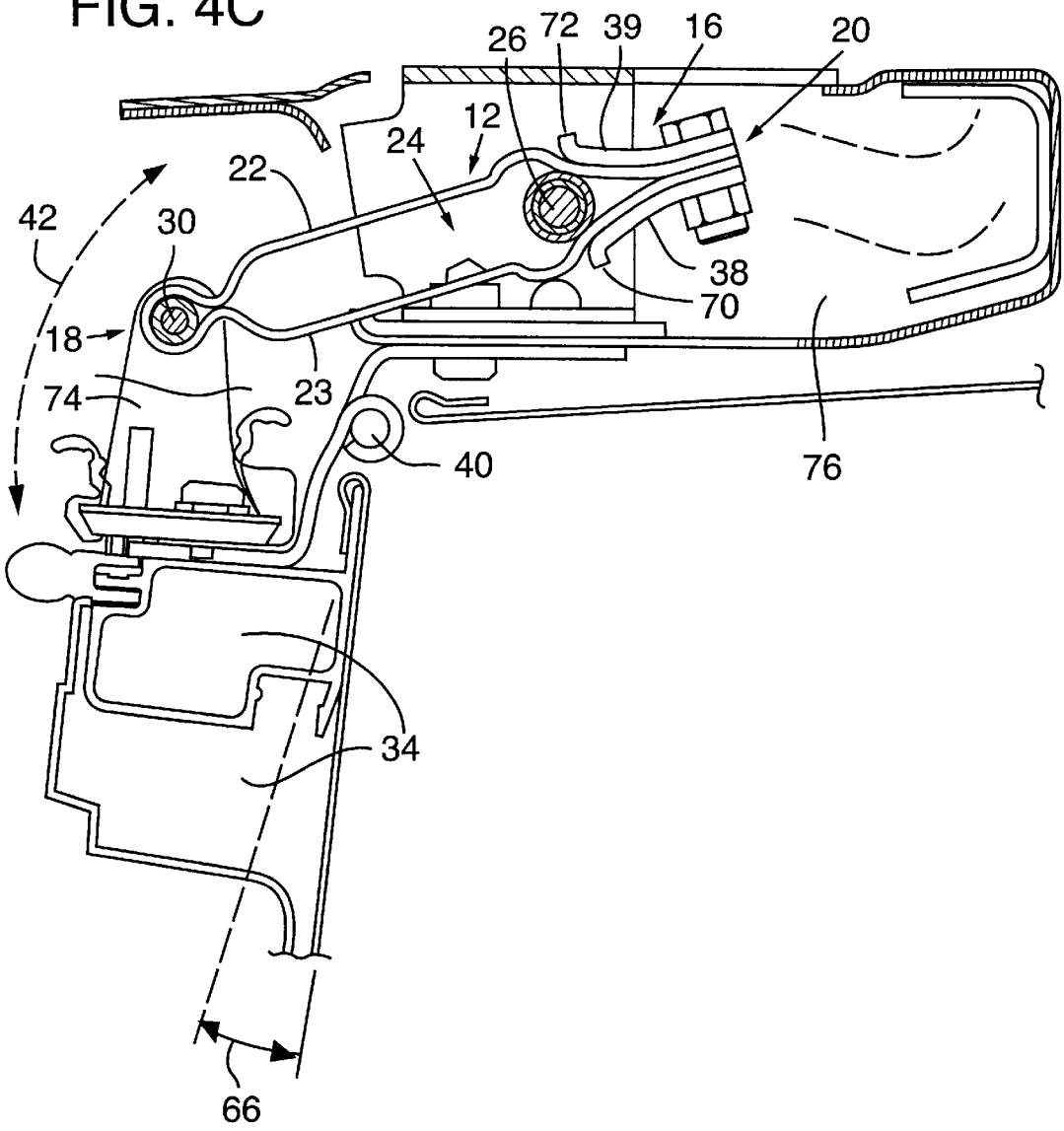
FIG. 4C is a top view of the embodiment of FIG. 4A with the door urged open beyond its normal open position.
Figure 5A:
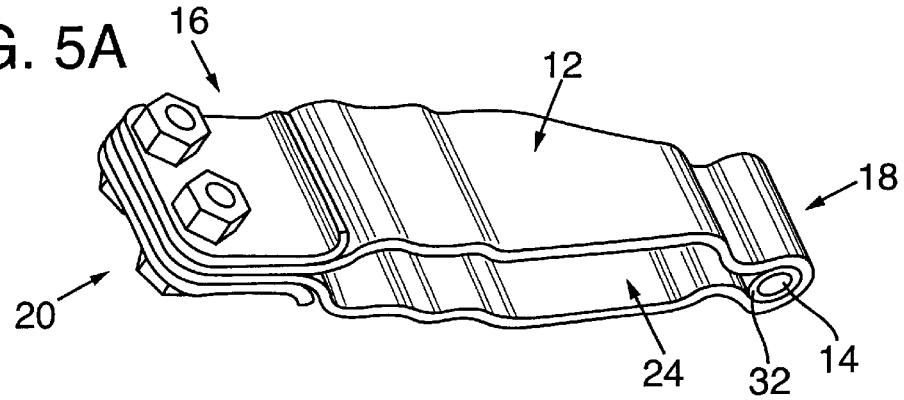
FIGS. 5A–5D illustrate alternative forms of door checks.
Figure 5B:
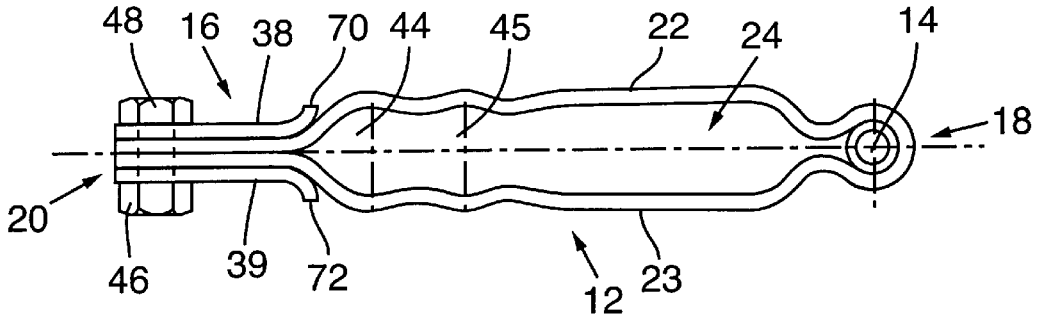
Figure 5C:
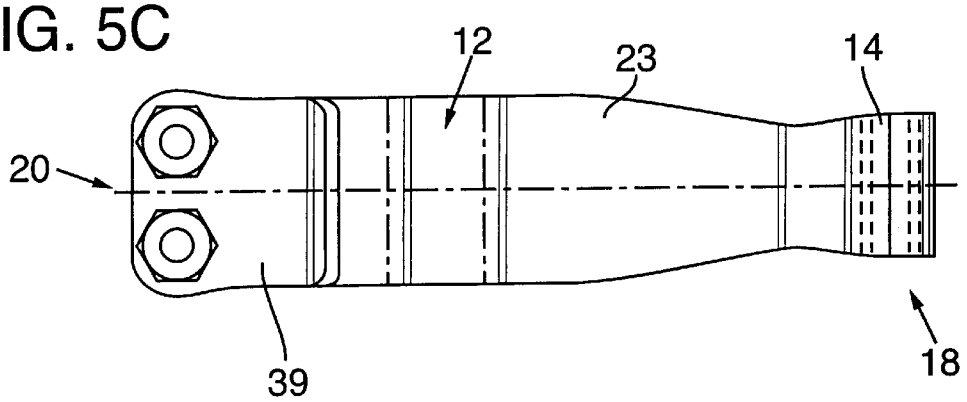
Figure 5D:
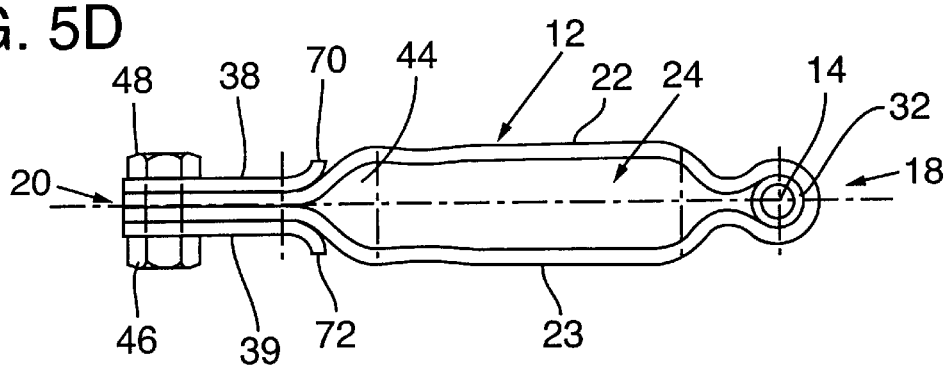

FIG. 4B shows the vehicle door 34 in a closed position. The slide pin 26 is positioned in the channel 24 near the first end portion 18 of the elongated body 12. FIG. 4A shows the vehicle door 34 in a normal full open position. The slide pin 26 is positioned in the channel 24 near the second end 20 of the elongated body 12 and rests within the stop position 44. FIG. 4C shows the vehicle door 34 opened beyond the normal open position as indicated by arc 66. The slide pin 26 is positioned in the channel 24 nearer to the second end portion 20 of the elongated body 12 than when in the normal full open position and has forced apart the side walls 22, 23 and spread apart first and second leaf spring elements 38, 39 which comprise one specific form of energy absorber 16.

In the illustrated form, the leaf spring elements may be of a resilient durable material, such as of 6150 hot-rolled 12 gauge steel. This material may be heat treated such as to 240 KSI minimum yield strength. Again, the strap forming body 12 may be similarly heat treated. The respective ends 70, 72 of leaf spring elements 38, 39 may be flared or turned outwardly from the adjoining wall sections 23, 22. Consequently, ends 70, 72 of the leaf elements do not mar or gouge the walls 23, 22 when excess energy absorption occurs as shown in FIG. 4C.

When the door 34 is opened beyond its normal full open position, the slide pin 26 is no longer positioned in stop position 44 and forces the side walls 22, 23 apart, thus engaging the energy absorber 38. This movement of the elongated body 12 relative to the slide pin 26 creates an axial resistance force directed along the longitudinal axis of the elongated body 12 toward the first end portion 18 of the elongated body 12. This force opposes the movement of end portion 20 toward the slide pin 26. As a result, a portion of the mechanical energy created by the movement of the door is absorbed. Thus, in the illustrated embodiment, some of the mechanical energy is absorbed as the leaf spring elements 38, 39 are spread apart. The leaf spring elements also urge the door back toward its full open position from this excessively open position following the relief of excessive door opening forces on the door.

The illustrated form of door check is designed to withstand a door free falling through seventy degrees. For example, such a free fall could occur if a cab over engine vehicle has its cab shifted about ninety degrees to a position where the cab windshield faces the ground during vehicle service and a door falls open. As a specific design criteria, the energy absorber, door check and coupling structure and door hinges may withstand nine thousand pounds of door opening force.

The illustrated energy absorber 16 is generally placed adjacent to the second end portion 20 of the elongated body 12. Although other constructions may be used, the leaf spring elements 38, 39 are shown outside of the walls 23, 22 with the walls sandwiched at least partially between the leaf spring elements.

The energy absorber does not necessarily have to be a leaf spring. Any device or mechanism capable of (a) absorbing part of the mechanical energy created by the movement of the slide pin, and (b) creating a net force in opposition to the movement of the slide pin 26 relative the elongated body 12 will function as an energy absorber. The energy absorber could be an alternative embodiment which, like the leaf spring elements of the working embodiment, comprises first and second spring elements which direct opposing forces into the channel of the elongated body. When engaged by the side walls or the slide pin, such first and second spring elements would create a net opposing force directed along the longitudinal axis of the elongated body toward the first end of the elongated body.

The first end portion 18 of the door check may be mounted by a bracket 74 to the door 34 in the space adjacent to the vehicle door 34 and door frame 58. As FIGS. 1 and 2 show, when the illustrated door check is mounted to a vehicle, the second end portion 20 of the elongated body 12 is positioned in a space 76 within the vehicle structure while the first end 18 of the elongated body 12 extends into the space between the door 34 and door frame 58 adjacent to the door hinge 40. The slide pin 26 is coupled to a bracket 56 and the bracket 56 is fixed to the vehicle structure adjacent the door 34. A pivot pin 30 is passed through the pivot opening 14 and coupled to the mounting bracket 74 which is then mounted on the door 34.

In the configuration pictured in FIGS. 1 and 2, opening the door 34 pulls the pivot pin 30 away from the slide pin 26 (as also seen in FIGS. 4A–C). The elongated body 12 is pulled into the space between the door 34 and door frame 58 adjacent to the door hinge 40 causing the elongated body 12 to move relative to the slide pin 26. The door 34 may be opened until it reaches its normal open position when the slide pin 26 is positioned near the second end portion 20 of the elongated body 12 in the stop position 44. If the door 34 is forced to open further, beyond its normal open position, the energy absorber 16 will be engaged, as described above.

FIGS. 5A–5D disclose alternative forms of door checks wherein the elongated body has a slightly different configuration from the forms shown in FIGS. 3A–3D. The FIGS. 5A–5C form have two door position stop locations. In contrast, the FIG. 5D form has one door position stop location.

Having illustrated the principles of the invention with reference to several embodiments, it should be apparent to those of ordinary skill in the art that the present invention may be modified without departing from such principles and is not limited to the illustrated embodiments. I claim as my invention all such modifications which fall within the spirit and scope of the following claims.

I claim:

1. A vehicle door check apparatus for limiting the extent to which a door pivots from a closed position to an open position away from a door frame which defines a door opening, the door carrying a pivot pin, and a slide pin being coupled to the vehicle adjacent to the door frame, the door check apparatus comprising:

an elongated body having first and second end portions and having opposing side walls, the side walls defining a channel for receiving the slide pin within the channel;

the first end portion of the elongated body defining an opening for pivotally receiving the pivot pin whereby, as the door is opened, the elongated body moves relative to the slide pin so as to shift the second end portion of the elongated body toward the slide pin;

an energy absorber adjacent to the second end portion of the elongated body in a position to absorb energy as the door reaches its open position and the slide pin is positioned at the second end portion of the body.

2. The apparatus of claim 1 wherein the energy absorber is detachably coupled to the second end portion of the elongated body.

3. The apparatus of claim 1 wherein the energy absorber substantially surrounds the second end portion of the elongated body.

4. The apparatus of claim 1 wherein the elongated body has a longitudinal axis and wherein the energy absorber creates a net opposing force directed along the longitudinal axis of the elongated body toward the first end portion of the elongated body.

5. The apparatus of claim 1 wherein the energy absorber comprises first and second spring elements mounted to the second end portion of the elongated body in a position to spread apart from one another to absorb energy as the second end portion of the body engages the slide pin.

6. The apparatus of claim 5 wherein each of the spring elements comprises an elongated leaf having first and second ends, the second end being nearer to the first end portion of the elongated body than the second end portion of the body, and wherein the second end of each spring element has an end portion which projects away from the elongated body.

7. The apparatus of claim 1 wherein the elongated body is formed from a one-piece elongated strap.

8. The apparatus of claim 1 wherein the side walls of the elongated body diverge and reconverge between the first and second end portions at least once to form at least one stop position adapted to receive and yieldably hold the slide pin.

9. The apparatus of claim 1 wherein the side walls diverge and reconverge between the first and second end portions a plurality of times to form a plurality of stop positions adapted to receive and yieldably hold the slide pin.

10. A vehicle door check apparatus for limiting the extent to which a door pivots from a closed position to an open position away from a door frame, the door check apparatus comprising:

an elongated body having first and second end portions and having opposing side walls, the side walls defining a slide pin receiving channel;

the first end portion of the elongated body defining an opening; and an energy absorber comprising first and second spring elements coupled to the second end portion of the elongated body and adapted to resist the spreading apart of the side walls by a slide pin positioned within the channel.

11. The apparatus of claim 10 wherein each of the spring elements comprising an elongated leaf having first and second ends, each leaf being substantially parallel to the side walls of the elongated body, and wherein the second end of each leaf is nearer to the first end portion than the first end of each leaf.

12. The apparatus of claim 11 wherein the elongated leafs are detachably coupled to the second end portion of the elongated body.

13. The apparatus of claim 11 wherein the second end of each leaf projects away from the elongated body.

14. The apparatus of claim 10 wherein the side walls are positioned at least partially between the first and second spring elements.

15. The apparatus of claim 10 wherein the elongated body is formed from a one-piece elongated strap.

16. The apparatus of claim 10 wherein the side walls of the elongated body diverge and reconverge between the first and second end portions at least once to form at least one stop position.

17. The apparatus of claim 16 wherein the side walls diverge and reconverge between the first and second end portions a plurality of times to form a plurality of stop positions.

18. A vehicle door check apparatus for limiting the extent to which a door pivots from a closed position to an open position away from a door frame, the door carrying a pivot pin and a slide pin being coupled to the vehicle adjacent to the door frame, the door check apparatus being detachably positioned in the space adjacent to the door and door frame, the door check apparatus comprising:

an elongated body having first and second end portions and having opposing side walls and a longitudinal axis, the side walls defining a channel for receiving the slide pin within the channel, the elongated body being formed from a one-piece elongated strap, the first end portion of the elongated body defining an opening for pivotally receiving the pivot pin whereby, as the door is opened, the elongated body moves relative to the slide pin to position the slide pin toward the second end portion of the elongated body;

the side walls of the elongated body diverging and reconverging between the first and second end portions at least once to form at least one stop position adapted to receive and yieldably hold the slide pin; and a leaf spring comprising first and second leaf elongated elements detachably coupled to the second end portion of the elongated body in a position to spread apart from one another to absorb energy as the second end portion of the body engages the slide pin, each of the spring elements having first and second ends, the second end being nearer to the first end of the elongated body than the second end, and wherein each second end has an end portion which projects away from the elongated body.

* * * * *